United States Patent [19]

Thomas

[11] Patent Number: 4,672,336

[45] Date of Patent: Jun. 9, 1987

[54] ATTENUATORS

[75] Inventor: Neil E. Thomas, St. Albans, England

[73] Assignee: Marconi Instruments Limited, St. Albans, England

[21] Appl. No.: 731,954

[22] Filed: May 8, 1985

[30] Foreign Application Priority Data

May 11, 1984 [GB] United Kingdom ..... 8412141

[51] Int. Cl.[4] ..... H01P 1/22

[52] U.S. Cl. ..... 333/81 A; 338/308; 338/333

[58] Field of Search ..... 333/81 A; 338/308, 309, 338/333, 334

[56] References Cited

U.S. PATENT DOCUMENTS

| | | | |
|---|---|---|---|
| 2,471,732 | 5/1949 | Feenberg | 333/81 A X |
| 2,899,665 | 8/1959 | Cowles | 338/333 X |
| 4,272,739 | 6/1981 | Nesses | 333/81 A |

*Primary Examiner*—Paul Gensler

*Attorney, Agent, or Firm*—Spencer & Frank

[57] ABSTRACT

An attenuator is in the form of a pad comprising a coating of resistive material which connects an input port, an output port and a pair of linked constant potential ports. The regions of the pad adjacent to the outer edges of the input port are provided with outwardly pointing cusps with curved boundary edges. These reduce current crowding at the edges of the input port, and avoid localized overheating of the adjacent regions of the pad, which could result in pad failure.

9 Claims, 4 Drawing Figures

ATTENUATORS

This invention relates to attenuators of the kind which comprise a pad typically in the form of a coating of electrically resistive material on an insulating support, the resistance which the coating presents between electrical input, output and constant potential ports determining the extent to which an applied input signal is attenuated. A typical attenuator pad is connected not only to input and output signal ports, but also to a constant potential port, usually at earth potential.

One such known attenuator is illustrated in FIG. 1 of the accompanying drawings.

The attenuator consists of rectangular attenuator pad 1 consisting of a thin coating of resistive material on a substrate 2 composed of alumina. It connects together an input port 3 and an ouput port 4, both of which comprise the ends of electrically conductive tracks 5 and 6 which are in the form of elongate coatings of a suitable metal such as gold. The pad 1 has a lateral dimension which is greater than the width of the tracks 5 and 6 so that its end edges contact electrically conductive regions 7, 8 which are held at a common constant potential, usually earth. The thickness and resistivities of the tracks 5 and 6 and the regions 7 and 8 are chosen so as to exhibit a very low electrical impedance as compared with that of the attenuator pad itself.

It is found that such attenuators are not tolerant to power overloads, but can fail after a relatively short useful lifetime. The present invention seeks to provide an improved attenuator.

According to a first aspect of this invention an attenuator includes a resistive attenuator pad having an input port where it contacts an electrically conductive track, the pad being shaped locally in the regions of the two outer edges of the track so as to form respective cusps projecting outwardly from the body of the pad.

According to a second aspect of this invention an attenuator includes a resistive attenuator pad having a generally rectangular shape with portions of first and second opposite edges thereof contacting respective electrically conductive tracks to constitute input and output ports, and the third and fourth edges being provided with contacts to constitute constant potential ports, the pad being shaped locally in the regions of the two outer edges of the track at the input port to form respective cusps projecting outwardly from the body of the pad, the portions of the cusps lying towards the constant potential ports being profiled to relieve current crowding at the extremities of the input port.

It is believed that the rectangularly shaped attenuator pads of the kind illustrated FIG. 1 fail under power overload due to the very non-uniform current distribution around the sharp corners at the end of the input conductive track in the region of the input port. This causes a large part of the power dissipated to be lost in the small region where the current is forced to change direction abruptly. Overheating of the attenuator pad can quickly lead to total failure. It has been found that the provision of the small cusps at the input port very significantly overcomes this problem and permits a very much higher power overload to be tolerated. The cusps can be very small in relation to the overall dimensions of the attenuator pad and the width of the conductive tracks This permits the effective resistance of the attenuator pad to remain largely unaltered as compared with that of the perfect rectangular shape.

The invention is described with reference to the accompanying drawings in which

Figure 1:
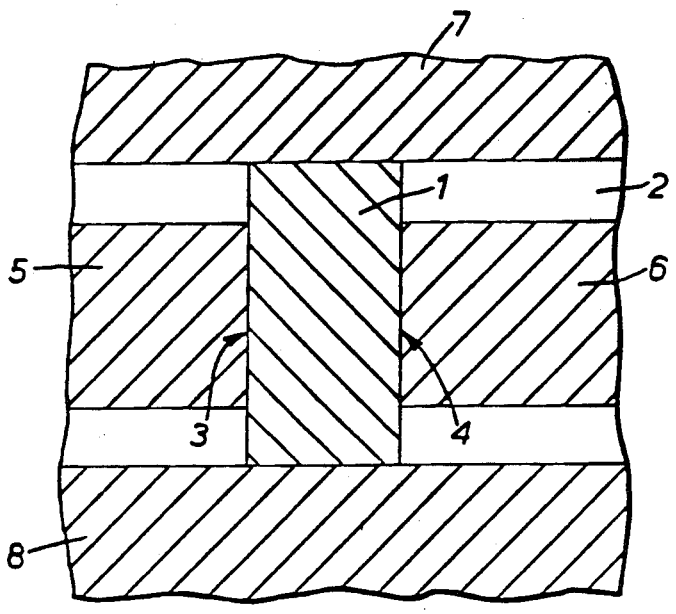
FIG. 1. (PRIOR ART)
FIG. 1 shows a prior art attenuator.
Figure 2:
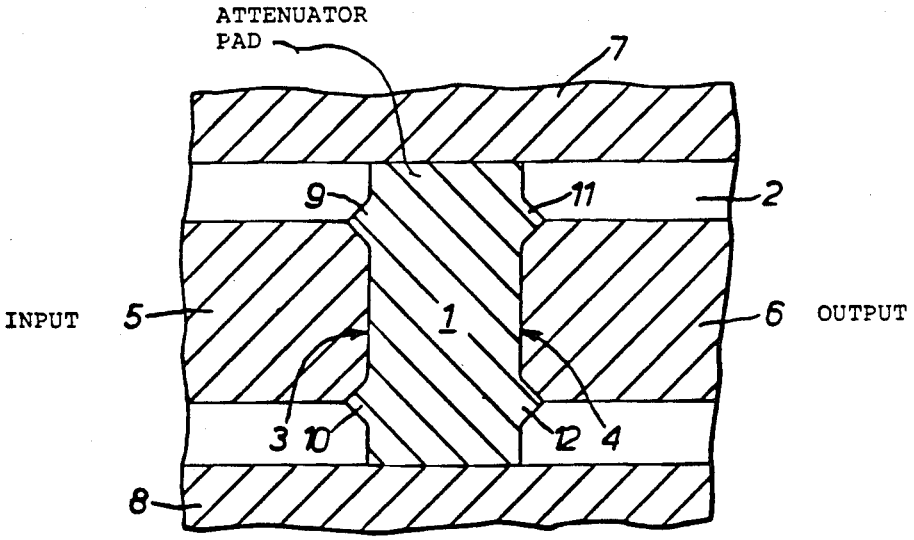
FIG. 2 illustrates diagramatically an improved attenuator.

Referring to FIG. 2 it will be seen that it is generally similar to the configuration illustrated in FIG. 1, and for like parts the same reference numerals have been used. The cross hatching in FIGS. 1 and 2 does not serve to indicate a sectional view, but rather serves to differentiate surface areas of different kinds. Thus the hatched areas 5, 6, 7 and 8 represent electrically conductive material having an extremely low resistance whereas the hatched area 1 represents the high resistivity attenuator pad. The unshaded area 2 represents those portions of the support which are visible from above.

The attenuator shown in FIG. 2 differs from that in FIG. 1 by the provision of four small cusps. Cusps 9 and 10 are associated with the input port 3 and cusps 11 and 12 are associated with the ouput port 4. The cusps simply represent localized extensions of the area of the attenuator pad which terminate in sharp projecting points. The point of the cusps typically has an angle of about 90° and the base of the cusps curves smoothly to merge into the body of the attenuator pad with minimum discontinuity. The cusps are in fact very small as compared with the dimension of the attenuator pad 1 and the transverse dimension of the electrical tracks 5 and 6. Typically the width of the attenuator pad 1, i.e. the spacing between the contact areas 7 and 8 is about 3 mm whereas the extent by which the cusps project from the body of the attenuator pad is only about 0.2 mm.

Figure 3:
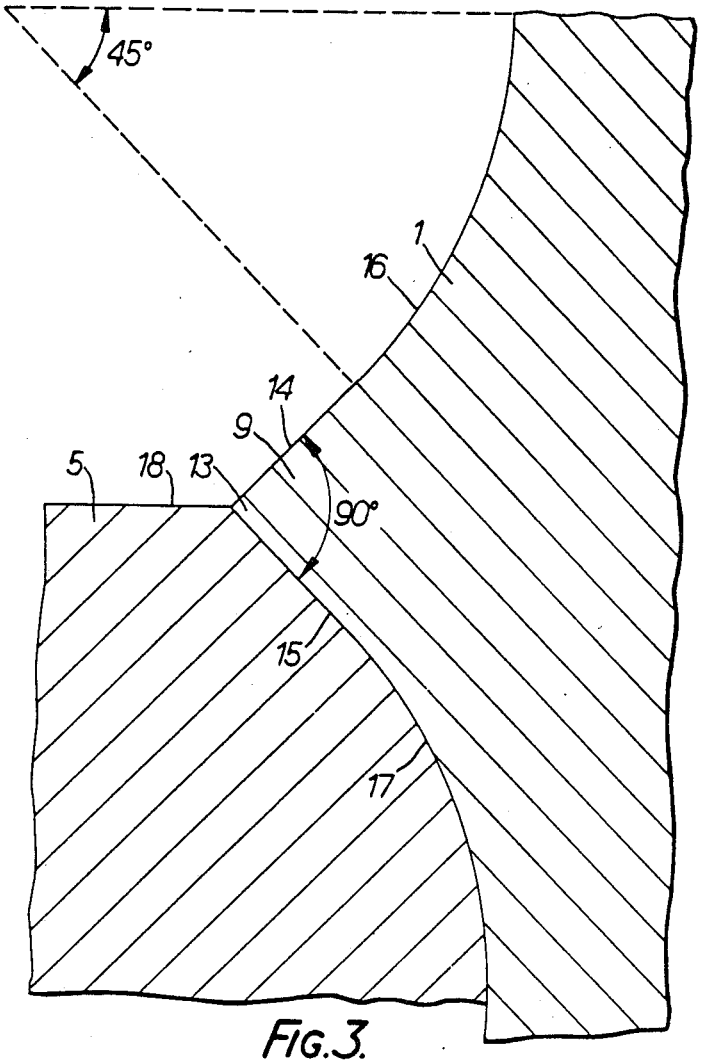
FIG. 3 is an explanatory diagram.

The profile of a cusp is illustrated in greater detail in FIG. 3. The apex 13 of the cusp has an angle of 90°, and consists of two straight sided boundaries and 15 which run smoothly into curved base portions 16 and 17 of the cusp. Each base portion has a circular profile and extends over an arc of about 45°. This angle is not critical and may be increased or decreased slightly. The included angle of the apex of the outer point of the cusps is about 90°, as marked on FIG. 3.

The effect of the provision of the cusp is that current flowing from the electrical track 5 into the attenuator pad 1 crosses the boundary in a direction which is perpendicular to the section 15 so that the current continues to flow in a direction parallel to the line 14. This avoids any tendency of current crowding within the attenuator pad material at the edge 18 of the conductive track and the edge 14 of the attenuator pad. This avoids the likelihood of localized overheating in this region and greatly prolongs the life of the attenuator. The relative lengths of the portions 14 and 16 can be altered to a significant extent, although it is very much preferred to have at least a short curved section 16 at the base of the cusp to avoid an abrupt discontinuity in profile. Although the profile of the section 16 is circular in nature this is not essential. The profile of the section 17 is less critical, but preferably is the same as section 16.

Although in FIG. 2 four cusps 9, 10, 11 and 12 are illustrated it will be appreciated that as the bulk of the current flow in a conventional attenuator is from the input track 5 to the two conductive regions 7 and 8, which in practice are held at a constant potential, the cusps 11 and 12 do not contribute materially to the operation of the attenuator. Nevertheless it is desired to make the device of a symmetrical shape so that if appropriate the output track 6 can act as an input track under the circumstances.

The attenuator finds ready application in the input path of an electrical test instrument. If the instrument has limited range capability it is desired to modify the amplitude of an input signal before it is applied to relatively sensitive input stages. The provision of an attenuator pad reduces the amplitude of the input signal by the required amount, and in practice the characteristics of the attenuator are chosen so that an appropriate amount of current flows along the electrical track 6.

Figure 4:
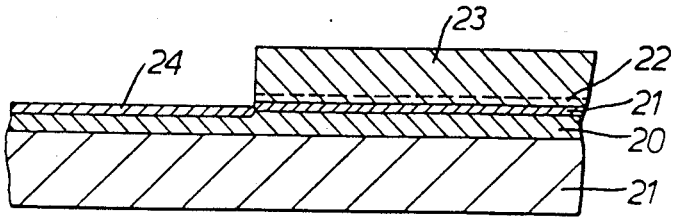
FIG. 4 is a sectional view showing the form of construction used.

A typical form of construction of the attenuator is illustrated in FIG. 4 in which a continuous coating 20 of tantalum nitride is laid down on an alumina ceramic substrate 21. The profile of the coating 20 conforms to that of the two tracks 5 and 6 and the attenuator pad 1 itself. A thin film of nichrome 21 is laid down over those portions of the tantalum 20 which correspond to the area of a conductive track, after which a thin layer of gold 22 is deposited. The thickness of the gold is subsequently increased to the required value by an electrolytic process. The exposed region of the tantalum is oxidized to form an oxide area 24. In practice the area 24 represents the extent of the attenuator pad 1 and the gold area 23 represents a conductive track. As the gold has an extremely high conductivity as compared with that of the tantalum the effective region of the attenuator pad 1 is determined by the boundary of the gold 23 so that the tantalum underlying the gold has very little electrical effect.

I claim:

1. An attenuator comprising a planar electrically conductive track having two outer edges and a transverse edge extending between said outer edges, and a resistive attenuator pad having an input port which contacts said transverse edge of said electrically conductive track, said pad being shaped locally in the regions of said two outer edges of said track so as to form respective cusps projecting outwardly from the body of said pad, each said cusp having an apex which has an angle of at least approximately 90° and which coincides with a respective outer edge of said track.

2. An attenuator as claimed in claim 1 further comprising a second electrically conductive track having two outer edges and a transverse edge extending between said two outer edges, and wherein said resistive attenuator pad has an output port opposite said input port and contacting said transverse edge of said second track, and said pad is shaped locally in the regions of said two outer edges of said second track so as to form respective cusps identical to said first-recited cusps.

3. An attenuator comprising two planar electrically conductive tracks each having two outer edges and a transverse edge extending between said outer edges, and a resistive attenuator pad having a generally rectangular shape delimited by opposed first and second edges and opposed third and fourth edges, each of said third and fourth edges extending between said first and second edges, with portions of said first and second edges each contacting said transverse edge of a respective electrically conductive track to constitute input and output ports, respectively, and said third and fourth edges being provided with contacts to constitute constant potential ports, said pad being shaped locally in the regions of the two outer edges of said track at said input port to form respective cusps projecting outwardly from the body of the pad, each said cusp having a portion which extends toward a respective constant potential port and which is profiled so as to extend towards the body of said pad in a smooth curve, each said cusp having an apex which has an angle of at least approximately 90° and which coincides with a respective outer edge of said track at said input port.

4. An attenuator as claimed in claim 3 and wherein the outer edges of the tracks are perpendicular to the major portions of the first and second edges of the rectangularly shaped pad, with each cusp being symmetrically shaped and positioned with respect to the line of a respective outer edge of the associated track.

5. An attenuator as claimed in claim 3, and wherein each cusp terminates at its apex in straight line sections.

6. An attenuator as claimed in claim 5, and wherein the base of each cusp is curved with the ends of the curves merging smoothly with said pad edge at said input port and with said straight line sections.

7. An attenuator as claimed in claim 6 and wherein the curved base sections are in the form of circular arcs subtending angles of 45°.

8. An attenuator comprising two planar electrically conductive tracks each having two outer edges and a transverse edge extending between said outer edges, and a resistive attenuator pad having a generally rectangular shape delimited by opposed first and second edges and opposed third and fourth edges, each of said third and fourth edges extending between said first and second edges, with portions of said first and second edges each contacting said transverse edge of a respective electrically conductive track to constitute input and output ports, respectively, and said third and fourth edges being provided with contacts to constitute constant potential ports, said pad being shaped locally in the regions of the two outer edges of said track at said input port to form respective cusps projecting outwardly from the body of the pad, each sad cusp having an apex and a portion which extends toward a respective constant potential port and which is profiled to relieve current crowding at the extremities of the input port, wherein each said cusp terminates at its apex in straight line sections and the base of each said cusp is curved, with the ends of the curves merging smoothly with said pad edge at said input port and with said straight line sections.

9. An attenuator as claimed in claim 8 and wherein the curved base sections are in the form of circular arcs subtending angles of 45°.

* * * * *